US010142758B2

(12) United States Patent
Sikora

(10) Patent No.: US 10,142,758 B2
(45) Date of Patent: Nov. 27, 2018

(54) SYSTEM FOR AND A METHOD OF GENERATING SOUND

(71) Applicant: HARMAN BECKER AUTOMOTIVE SYSTEMS MANUFACTURING KFT, Szekesfehervar (HU)

(72) Inventor: Grzegorz Sikora, Munich (DE)

(73) Assignee: HARMAN BECKER AUTOMOTIVE SYSTEMS MANUFACTURING KFT, Szekesfehervar (HU)

( * ) Notice: Subject to any disclaimer, the term of this patent is extended or adjusted under 35 U.S.C. 154(b) by 0 days.

(21) Appl. No.: 14/912,894

(22) PCT Filed: Aug. 15, 2014

(86) PCT No.: PCT/EP2014/067503
§ 371 (c)(1),
(2) Date: Feb. 18, 2016

(87) PCT Pub. No.: WO2015/024881
PCT Pub. Date: Feb. 26, 2015

(65) Prior Publication Data

US 2016/0205491 A1 Jul. 14, 2016

(30) Foreign Application Priority Data

Aug. 20, 2013 (DK) ..... PA 2013 00471
Sep. 19, 2013 (DK) ..... PA 2013 00535

(51) Int. Cl.
*H04S 7/00* (2006.01)
*H04R 3/12* (2006.01)
(Continued)

(52) U.S. Cl.
CPC ..... *H04S 7/302* (2013.01); *H04R 3/12* (2013.01); *H04R 29/001* (2013.01); *H04S 3/002* (2013.01);
(Continued)

(58) Field of Classification Search
CPC . H04S 7/302; H04S 7/40; H04S 3/002; H04S 1/002; H04S 7/30; H04S 7/303;
(Continued)

(56) References Cited

U.S. PATENT DOCUMENTS 5,684,259 A * 11/1997 Horii ..... G10H 1/0008 84/600
8,045,732 B1 10/2011 Goodwin et al.
(Continued)

FOREIGN PATENT DOCUMENTS

EP 0740410 A1 10/1996
JP 2004361845 A 12/2004
(Continued)

OTHER PUBLICATIONS

Denmark Search Report and Examination Report for corresponding Application No. PA 2013 00471, dated Feb. 27, 2014, 6 pages.
(Continued)

*Primary Examiner* — Yogeshkumar Patel
(74) *Attorney, Agent, or Firm* — Brooks Kushman P.C.

(57) ABSTRACT

A system for and a method of outputting sound having a variable apparent source distance and/or width is provided. The system may be used in a vehicle and the apparent source distance may be varied depending on parameters of a driving style or a driver's behavior.

18 Claims, 2 Drawing Sheets

Figure 1:
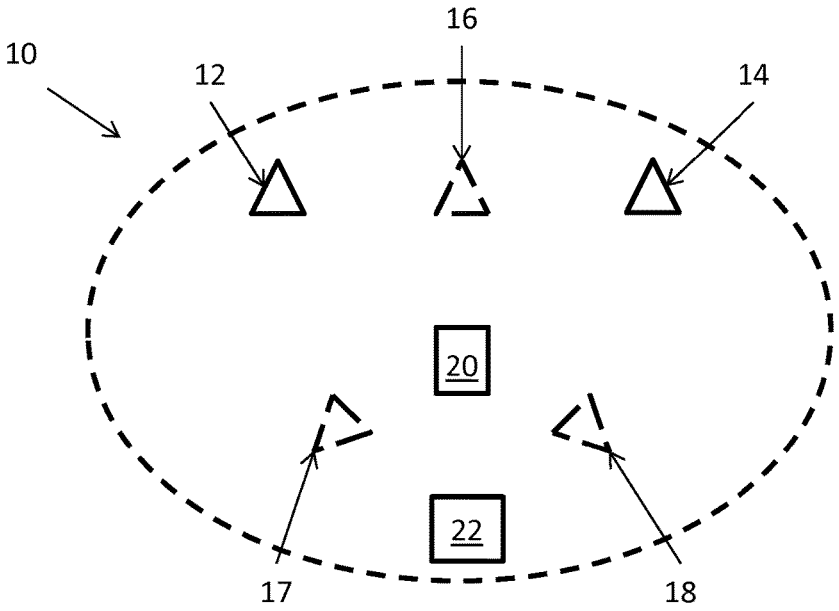

(51) Int. Cl.
*H04R 29/00* (2006.01)
*H04S 3/00* (2006.01)
*H04S 1/00* (2006.01)

(52) U.S. Cl.
CPC ..... *H04S 7/40* (2013.01); *H04R 2499/13* (2013.01); *H04S 1/002* (2013.01)

(58) Field of Classification Search
CPC .... H04R 3/12; H04R 29/001; H04R 2499/11; H04R 2499/13; H04R 3/00; H04R 3/002; A63F 2300/301
USPC ..... 381/309, 107, 119, 1, 86, 56, 71.4, 300, 381/302; 700/94
See application file for complete search history.

(56) References Cited

U.S. PATENT DOCUMENTS

| | | | | |
|---|---|---|---|---|
| 2003/0236582 | A1* | 12/2003 | Zamir | G11B 27/002 700/94 |
| 2006/0045294 | A1 | 3/2006 | Smyth | |
| 2008/0002839 | A1 | 1/2008 | Eng | |
| 2008/0160943 | A1 | 7/2008 | Sung et al. | |
| 2009/0116652 | A1* | 5/2009 | Kirkeby | H04S 7/303 381/1 |
| 2009/0310799 | A1 | 12/2009 | Suzuki et al. | |
| 2012/0288126 | A1* | 11/2012 | Karkkainen | H04R 3/005 381/309 |
| 2013/0120114 | A1 | 5/2013 | Gu et al. | |

FOREIGN PATENT DOCUMENTS

| | | | |
|---|---|---|---|
| JP | 2010154466 | A | 7/2010 |
| WO | 2009023289 | A1 | 2/2009 |
| WO | 2010138309 | A1 | 12/2010 |
| WO | 2012004057 | A1 | 1/2012 |
| WO | 2012160415 | A1 | 11/2012 |

OTHER PUBLICATIONS

Danish Search Report for corresponding Application No. PA 2013 00535, dated May 7, 2014, 7 pages.
International Search Report and Written Opinion for corresponding Application No. PCT/EP2014/067503, dated Nov. 12, 2014, 10 pages.
International Preliminary Report for corresponding Application No. PCT/EP2014/067503, dated Feb. 23, 2016, 7 pages.
https://www.techwalla.com/articles/how-to-set-your-stereo-equalizer, "How to Set Your Stereo Equalizer", May 3, 2017, 6 pages.
https://en.wikipedia.org/wiki/Sound_Retrieval_System, "Sound Retrieval System", May 3, 2017, 2 pages.
Kasbach et al., "The relation between perceived apparent source width and interaural cross-correlation in sound production spaces with low reverberation", Centre for Applied Hearing Research, Technical University of Denmark (DTU), 4 pages.
Forum Acusticum Sevilla 2002 Technical Programme, 2002, 86 pages.

* cited by examiner

SYSTEM FOR AND A METHOD OF GENERATING SOUND

CROSS-REFERENCE TO RELATED APPLICATION

This application is the U.S. national phase of PCT Application No. PCT/EP2014/067503 filed on 15 Aug. 2014, which claims priority to DK Application Nos. PA 2013 00471 filed on 20 Aug. 2013 and PA 2013 00535 filed on 19 Sep. 2013, the disclosures of which are incorporated in their entirety by reference herein.

The present invention relates to a system and a method of generating sound having a variable apparent source width at a listening position.

Different manners of adapting sound to a user or music genre may be seen in US2009/0076637, JP2004361845, U.S. Pat. No. 8,045,732, EP0740410 as well as in:

The Burmester High-End 3D Surround Sound provides Pure, Live, Easy Listening and Surround sound modes between which the user may choose. The difference between modes, apart from equalization, includes processing of the sound stage width.

Harman Kardon Logic 7—sound stage width increases when turning the algorithm on and off and changing its sound modes (theatre, concert hall)

In a first aspect, the invention relates to an audio system comprising a plurality of sound generators, positioned in relation to a listening position, and a controller having a sensor configured to detect a position or activity of the system and/or a user and output a corresponding value, the controller being configured to convert, based on the value, an audio signal into a speaker signal for each sound generator, and the sound generators each being configured to receive its speaker signal and output sound, wherein different values cause the sound to have different apparent source widths at the listening position.

In this context, an audio system is a system for outputting sound. Naturally, the system may also provide images/video or other information if desired. The system may be monolithic or made up of a plurality of elements suitably interconnected via wires, wirelessly or a combination thereof.

The system comprises a number of sound generators. A sound generator usually is configured to receive a signal and convert the signal into sound. Passive sound generators usually convert the signal to sound simply by feeding the signal into one or more loudspeaker units, possibly through a crossover filter. Passive sound generators thus receive the energy in the signal. Active loudspeakers, in contrast, receive energy from a power source and thus are able to amplify the signal received, in addition to other processing (filtering, delay etc.) if desired. Active sound generators may receive wireless signals.

The listening position may be an intended position of a listener or a part, such as the head, of a listener. Usually, the sound generators are positioned suitably in relation to the listening position, often symmetrically. Usually, two or more sound generators are positioned in front of the listening position emitting sound toward the listening position in order to generate multi channel sound. In simple set-ups, signals representing a left and a right side signal are fed to a left and a right sound generator, but in many situations, it is not possible to position the sound generators symmetrically in relation to the listening position. In such situations, audio processing may be performed in order to have the sound experienced at the listening position sound as if the sound generators were positioned symmetrically in relation to the listening position. One example of a system of this type is a car, where the sound generators may be positioned symmetrically in relation to the cabin of the car but not around the seats. Thus, to obtain a sufficiently acceptable sound to the driver, when no passengers are present, the sound from the sound generators may be altered electronically to have it sound as if coming from sound generators positioned correctly around the listening position.

The system comprises a controller configured to convert an audio signal into a speaker signal for each sound generator.

The audio signal may be any type of signal representing an audio signal. The signal may be streamed, digital or analogue, or transmitted as packets. The signal may be derived from a storage internal or external to the processor. A storage may be a hard disc, flash drive, RAM/ROM, optical storage or any other type of data storage, including analogue storage. The signal may be derived from a remote source, such as an airborne radio signal and/or a network, wired or wireless, such as the internet, telephone network or the like.

The controller may be a monolithic or single element receiving the audio signal and forwarding the speaker signals. Alternatively, part of the controller or conversion may be distributed, such as to processors present in one or more of the sound generators. The processor may comprise one or more signal processors, such as DSPs, ASICs, FPGAs, software programmable or hardwired, and any combination thereof.

A usual processor of this type may, in addition to amplifying signals to be fed to loudspeaker element(s) of the sound generators, provide a filtering to e.g. transmit higher frequencies to tweeters and lower frequencies to woofers. Filtering may also be provided to alter the overall sound, such as putting emphasis on certain frequency bands (bass, treble, voice) or so as to take into account imperfections or reverb (resonance) in the loudspeaker elements, sound generators and/or a listening space comprising the sound generators and listening position.

The processing may also introduce delays in some speaker signals compared to other speaker signals. In this manner, the impingent direction of sound will seem altered at the listening direction, such as according to the law of the first wavefront. In some embodiments, this delaying may be used for generating so-called virtual speakers. In this manner, a virtual speaker may, due to the delay of one signal fed to one sound generator vis-á-vis that fed to another sound generator, be formed so that, from the listening position, it will sound as if sound is actually fed to the listening position from the virtual speaker.

Audio usually is produced so as to be provided to a user from in front of the user and across a stage or area in front of the user. The size or width of this scene or stage is often called the apparent source width in that it represents the width thereof and thus the distance between two sound generators which may generate this sound. Naturally, the distance between the sound generators may be larger (able to generate a larger apparent source width), as the above audio processing may be used to "narrow the stage" or reduce the apparent source width.

In one example, when listening to a song, it is discernible that the vocal usually is provided directly in front of the listening position, whereas guitars, bass, drums, choir etc. may be positioned more or less to the right or left of the vocal. Thus, the audio signal is generated to give the impression that the listener has in front of him/her the actual stage with the musicians positioned at those positions.

The controller is further configured to receive an input representing a value. Further below, different types of input are described as are different parameters which the value may reflect.

The controller is configured to base the conversion of the audio signal into the speaker signals also on the value, where different values cause the sound to have different apparent source widths at the listening position.

The subjective phenomenon of apparent or auditory source width (ASW) has been studied for a number of years, particularly by psychoacousticians interested in the acoustics of concert halls. See e.g. "difference limens for measures of apparent source width" by Matthias Blau and "the relation between the perceived apparent source width . . . " by Johannes Kasbach et al.

ASW relates to binaural decorellation of audio signals, i.e. the issue of how large a space a source appears to occupy from a sonic point of view and is best described as a 'source spaciousness' phenomenon. Early reflected energy in a space (usually up to about 80 ms) appears to modify the ASW of a source by broadening it somewhat, depending on the magnitude and time delay of early reflections. The interaural cross-correlation (IACC) is commonly used in room acoustics as an objective measure for ASW. Early reflections in a room cause a decorrelation of the two ear signals, i.e., a reduction of IACC, which leads to a larger ASW. The IACC describes the correlation between the left-ear signal, pl(t), and the right-ear signal, pr(t), normalised with their rms values. The resulting IACC coefficient corresponds to the maximum of the cross-correlation function ρlr(T), calculated with a delay time interval of $|\tau| \leq 1$ ms and using a time window of t2−t1. It takes values between zero and one:

$$\rho_{lr}(\tau) = \frac{\int_{t_1}^{t_2} p_l(t) p_r(t+\tau) dt}{\sqrt{\int_{t_1}^{t_2} p_l^2(t) dt \int_{t_1}^{t_2} p_r^2(t) dt}}$$

$$IACC = \max|\rho_{lr}(\tau)|$$

The other psychoacoustical parameters that can be modified are envelopment and spaciousness. The terms envelopment and spaciousness, and sometimes 'room impression', arise increasingly frequently these days when describing the spatial properties of sound reproducing systems. They are primarily related to environmental spatial impression, and are largely the result of reflected sound—almost certainly late reflected sound (particularly lateral reflections after about 80 ms). The problem with such phenomena is that they are hard to pin down in order that one can be clear that different people are in fact describing the same thing. It has been known for people also to describe envelopment and spaciousness in terms that relate more directly to sources than environments.

Spaciousness is used most often to describe the sense of open space or 'room' in which the subject is located, usually as a result of some sound sources such as musical instruments playing in that space. It is also related to the sense of 'externalisation' perceived—in other words whether the sound appears to be outside the head rather than constrained to a region close to or inside it. Envelopment is a similar term and is used to describe the sense of immersivity and involvement in a (reverberant) soundfield, with that sound appearing to come from all around.

Different manners exist for processing an audio signal to vary the apparent source width. Some of the known methods are:

- Converting the Left (L) and Right (R) signals from a stereophonic source or signal into Mid and Side (or M and S) component, where M=L+R and S=L−R. Then adjusting the balance between M and S, applying independent gain, filter and DSP processing on M and S signals before recombining them to L and R, may increase or reduce ASW.
- Extracting early and late reflections from the original source, processing and adding back to the original signal, may increase or reduce ASW. Moreover, depending on distribution and intensity of the processing, designer may also increase or reduce the spaciousness and envelopment in multi-speaker systems. In this situation, an "early reflection" may be a reflection causing the reflected signal to reach the listening position no more than 200 ms, such as no more than 150 ms, such as no more than 100 ms, no more than 80 ms, such as no more than 50 ms, such as no more than 25 ms, such as no more than 10 ms, such as no more than 5 ms later than a directly transmitted signal. Correspondingly, a "late reflection" may be seen when a reflected signal reaches the listening position more than 30 ms, such as more than 50 ms, such as more than 60 ms, preferably more than 80 ms later than a directly transmitted signal. Arrival of ER can vary between 5-100 ms, as it depends on room acoustics. What is heard in a recording, depending on the genre, is a kind of mix between natural ER and synthetized ER. It was proven by research that changing the properties of ER can change our perception of space, mainly its size. By extracting and manipulating ER (changing arrival time, changing timbre, changing distribution in time) we can change the impression of space which is strongly connected with stage or source width. Even one lateral reflection in the room can alter dramatically perception of ASW. In general, by altering frequency and time distribution of ER, one can alter perception of space, including ASW
- Synthetizing reverberation of different acoustical spaces and adding it to the original signal may change spatial properties of the system, similarly to the previous subpoint.

Thus, the controller may use any of the known methods to generate the speaker signals which, when output as sound, will have the ASW sought for. Additional methods are mentioned further below. As an example, a processor using any of the above methods, may adjust the balance, the independent gain, filter and/or DSP processing depending on the value. The extracting of the ER or LR, processing and/or adding thereof may also be made dependent of the value, as may the synthezisation and adding of the third method. Clearly, different parameters of the method selected may be made dependent on the value to obtain the desired ASW dependence on the value.

Naturally, the value may be updated or the controller may check the value and adapt the conversion frequently, intermittently, periodically or when prompted to do so. The controller may be prompted by realizing a change in the value and then adapt the conversion.

Alternatively, the controller may take part in also the altering of the value and thus automatically be aware of the change. The controller may ignore value changes below a threshold, or the value may be changed only if the parameter on which it is based varies above a predetermined threshold.

In general, the value is determined on the basis of a detected position or activity of the system and/or a user. A large number of situations exist in which this is an advantage.

The sensor of the controller may be a part of the controller or may be detached or detachable therefrom, such as so as to be attached to the person or another element, such as the below vehicle). The position may be used as a parameter in the determination of the value, such as from historical data. If the person or user has been in the same position, in the vicinity or in a similar position, the same or a similar value may be selected. In this context, a similar position may be within a predetermined distance from a previous position, a similar type of building (concert hall, school, work, shopping mall, shop, church, room, house, garage, gas station, parking lot, road, at the beach, in a park, in a forest, or the like. Similar positions may be positions along a similar type of road (standard road, dirt road, off-road, in a city, motorway, road works, side walk, pedestrian street, jogging paths, or the like), where similar circumstances are seen (road works, traffic jam, queuing, slow traffic, in a city or the like).

The position may also be used for, such as including road map information, determining what type of road or surroundings/circumstances the person/system is in/on and determine the value on the basis thereof. If the person is on a motorway or in the city, a lower angle may be desired compared to if the person is on a standard road.

In one embodiment, the detection of especially activity may be used for assessing a mood, concentration or cognitive/perceptive surplus of a person. If the person is moving a lot, the mood may be positive and the concentration low. This activity may be determined from movement of the person, as detected using a camera, a position detector (for e.g. detecting the below exemplified RFID tag) or a motion sensor attached to or affected by the person (waved about, moved by the moving person). Thus, the sensor may be provided in a watch or wrist worn element of the user or another portable element.

Alternatively, the activity may be that of the system, which may be the situation when the person affects the system, such as if the system is worn by the person or the person controls the system. The sensor may be a GPS sensor, a position sensor, a movement sensor, an acceleration sensor, or an element the position of which may be detected by a position detector, such as an RFID tag attached to or worn by the person.

In one situation, the system may be portable, such as a mobile telephone or a tablet. The sound generators then preferably also are portable, such as head phones, ear buds or separate speakers, such as connected via cables or a wireless connection to the processor, which may be that of the telephone/tablet. These watches/telephones/portables/tablets usually have sensors, such as GPS sensors, acceleration sensors, cameras and the like.

Alternatively, if the user is a driver of a vehicle, such as a car, a bus, a boat, a lorry/truck, a bicycle, a tricycle, a motor bike, a moped, an airplane or the like, the movement/activity may be an indication of a concentrated and lively driving style, whereby a high concentration and thus lower cognitive/perceptive surplus could be inferred.

In many situations, it is desired that the apparent source width decreases with decreased perceptive/cognitive surplus, such as if the user has other tasks, he/she must focus on. The value thus may be selected based on the amount of concentration the user must "reserve" for other tasks than listening to the sound.

A number of situations exist. A large amount of movement, such as a high velocity, may infer a concentrated person, whereas a large amount of movement of a person with no large positional change (waving about, dancing or the like) may infer a person with large surplus.

An aspect of the invention relates to a vehicle comprising an audio system according to the above aspect, the sensor being configured to detect a position or activity of the vehicle or a person therein.

Often, the sensor is configured to detect the behaviour of the user and/or of the vehicle.

In one set of embodiments, the sensor is configured to analyse/detect the user or a person within the vehicle. The sensor may estimate an amount of movement of the user, such as from analyzing images taken by a camera, such as a video camera. An infrared camera may determine a surface temperature of the person. A hot person may be busy driving or sick or may have less cognitive/perceptive surplus, which may affect the value.

Additionally, a microphone may be used for quantifying an amount of sound generated by the person(s) within the vehicle. The more talking/singing of the person(s), the more concentration may the driver use therefore and the less concentration or cognitive/perceptive surplus may the driver have for listening to the audio.

Another type of sensor may be used for identifying the user such as from an entering of an ID of the person. In one situation, the user is identified by the person selecting a seat memory setting. The position of the person is then known, and the value may be generated on the basis of this person.

Other sensor types relate to the operation of the vehicle. The sensor thus may be configured to determine an amount of movement/rotation of the steering wheel or depressions of accelerator/brake/clutch pedal(s) and base the determination of the value on this amount. This amount of movement/rotation may include the frequency of rotation/depression, speed of rotation/depression or the like and may be used for assessing the amount of concentration the user requires for his/her driving.

Yet another type of sensor may relate to the movement of the vehicle, such as an accelerometer, a position sensor, a velocity/speed sensor, a movement sensor, and/or a rotation sensor.

The speed of the vehicle may be used for assessing the concentration used for the driving and thus the amount of perceptive/cognitive surplus available for listening to the audio.

The frequency and/or sizes of accelerations/decelerations of the vehicle may be used in the same manner A lane change may be detected by a sideways acceleration/deceleration or re-positioning and/or it may be detected using a camera configured to detect the white stripes on the road.

This camera technology already exists in certain car brands and is used for e.g. vibrating the steering wheel if the car approaches other lanes or the side of the road—such as if the driver sleeps.

Yet another type of sensor relates to or detects the surroundings of the vehicle. If heavy traffic/roadwork is detected (such as by outboard cameras, wireless traffic announcements and/or radio broadcasts), if a small distance (such as below a threshold; such as set by the speed) exists to surrounding cars, if the weather is bad (such as low road temperature; outboard thermometer, and/or precipitation is detected e.g. detected by a precipitation detector), such conditions may also be used in the determination of the value.

A particularly interesting embodiment is one wherein the sensor is a velocity/speed sensor, the value relates to a velocity/speed of the vehicle and wherein the apparent source width decreases with increasing velocity/speed.

Naturally, any number of parameters and sensors may be used for the determination of the value, and any combination of the above sensor types or detection types may be selected. The parameters may be weighted so that some parameters have a larger weight than others. For example, a vivid driving style (e.g. large/many rotations of a driving wheel, lane changes, or activations of pedals) may overrule a large amount of singing/conversation in the vehicle so that the apparent source width is reduced even though the singing/conversation points to a less concentrated driver.

Naturally, if different ASW may be provided to different persons, such as in the vehicle, the value may differ from person to person, so that a driver may have a low ASW due to intense/fast driving, whereas a passenger may have a larger ASW due to a lot of singing/waving about in the vehicle.

Another aspect of the invention relates to a method of generating sound, the method comprising:

detecting a position or activity of an element or a person and generating a corresponding value, receiving an audio signal, providing a plurality of sound generators in relation to a listening position, converting the audio signal into a plurality of speaker signals and feeding each speaker signal to an individual sound generator to have the sound generators output sound, wherein different values cause the sound to have different apparent source widths at the listening position.

In this respect, the audio signal may be received from a storage which may be remote to the sound generators or close thereto, such as part of a system of which also the sound generators form a part and are connected to at least wirelessly. A remote storage may be a file server, file service, streaming service or the like available via the internet. The audio signal may be received via a wired connection and/or a wireless connection and may be received by an antenna, such as from an airborne signal, which may stem from an airborne radio signal.

A storage may be a hard disc, FLASH storage, RAM/ROM or the like which may be available in or from a controller which may be used for performing the conversion.

The audio signal usually is a multi channel signal, such as a stereo signal or a signal comprising more than 2 channels, such as 3, 4, 5, 6, 7, 8, 9 or more channels.

A mono signal may be converted into a multichannel signal if desired, but mono signals today are rare.

As mentioned above, the listening position may be an actual or intended position of a listener, and the sound generators may be positioned at or around this position. Usually, other considerations prevent the sound generators from being positioned optimally around or in relation to the listening position, but this may be corrected electronically by altering the signals fed to the sound generators.

The value may be input in a number of manners which is described above and further below.

The conversion converts the audio signal into a plurality of speaker signals which are each fed to a particular sound generator which output corresponding sound. Normally, the speaker signals for different sound generators are different.

As mentioned, different values cause the sound to have different apparent source widths at the listening position.

Again, the element may be fastened to the person or affected by the person, such as pushed or controlled by the person. The element may be portable or e.g. a vehicle or the like.

In one embodiment, the step of detecting the position/activity is performed intermittently, such as with fixed intervals. The processing may monitor the value and alter the conversion when the value has changed. In some embodiments, the conversion is only changed when the value has changed a sufficient percentage.

Above, different manners of using a position are mentioned. The position may be determined in many manners, such as using GPS, triangulation using the mobile telephone network or the like.

As mentioned above, the detection step may relate to an estimation of an activity level of the user. Some types of activities indicate that the user is concentrated on another assignment than listening to the audio and others indicate a user having perceptual/cognitive surplus to listen to the audio.

This step may be achieved by monitoring the movement of an element attached to, carried, worn or controlled by the user.

In one embodiment, the step of receiving the input comprises receiving a value relating to a vehicle and/or a person in the vehicle.

In this step, the above parameters relating to the behaviour of the person, such as frequency/magnitude of steering wheel rotations and/or operations of pedals, amount of singing, conversation, waving or the like.

In another embodiment, the detecting step comprises detecting a parameter of the vehicle. This sensor may be a camera, a microphone, an acceleration sensor and all other sensors mentioned above. The movement of the vehicle may be used as an indication as may detections of surroundings of the vehicle or the driving conditions. Thus, the value may relate to at least one of: an acceleration/deceleration of the vehicle, a position of the vehicle, a velocity/speed of the vehicle, an amount of or type of movement of the persona, an amount of sound generated by the person, an amount of or type of movement of an element controlled by the person.

In a preferred embodiment, the value relates to a velocity/speed of the vehicle and wherein the apparent source width decreases with increasing velocity/speed.

As mentioned, the value may be calculated or determined based on a number of the above parameters which may be given different weights, so that the driving style is seen as more important than an amount of singing in the vehicle.

Figure 2:
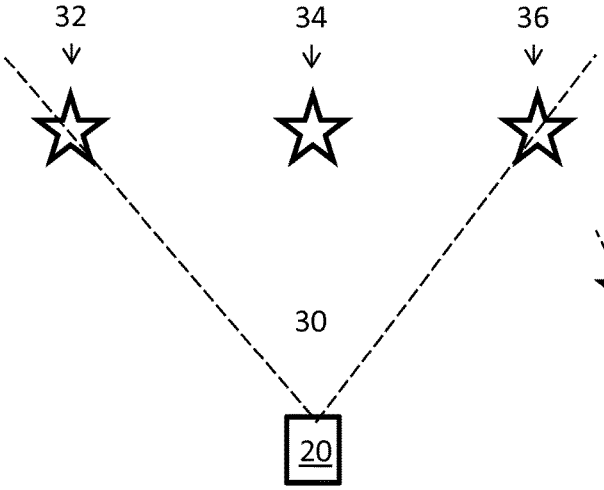
Figure 3:
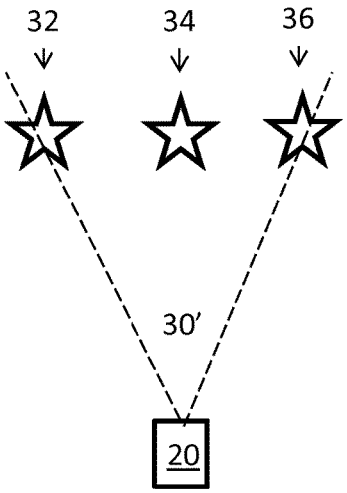
Figure 4:
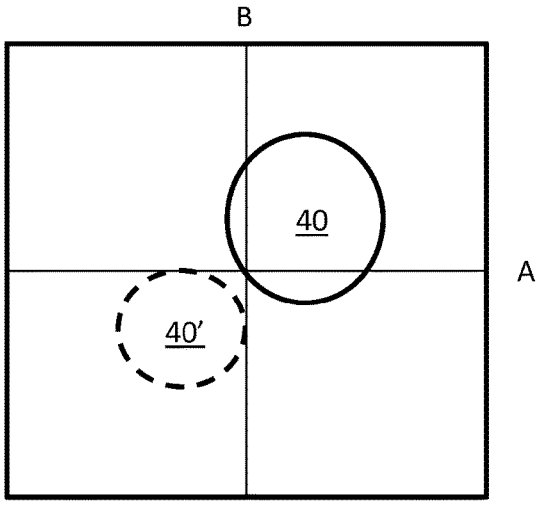
Figure 6:
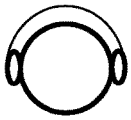
Figure 5:
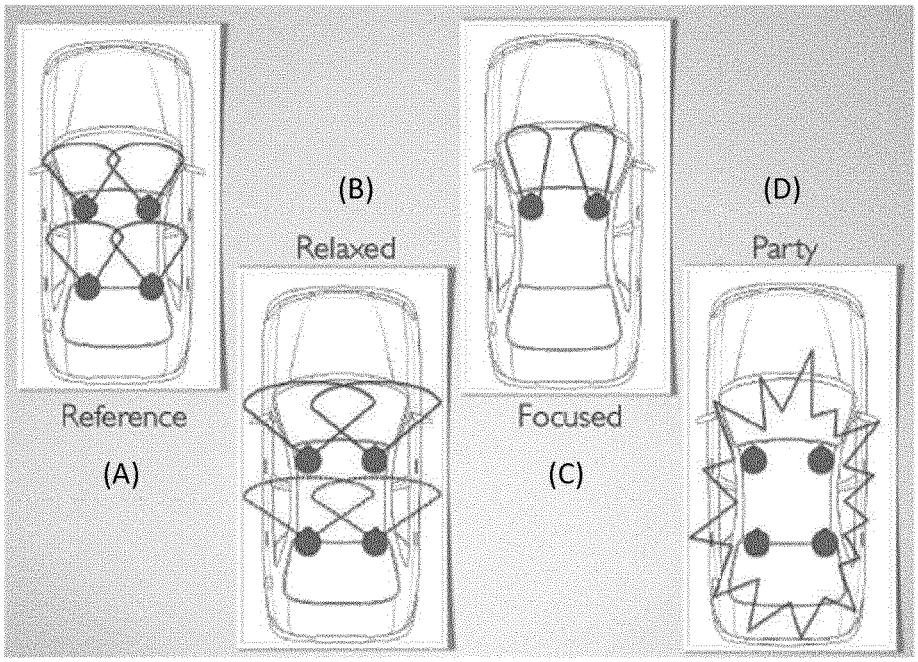

In the following, preferred embodiments of the invention will be described with reference to the drawing, wherein:

FIG. 1 illustrates a system according to a preferred embodiment of the invention, FIGS. 2, 3 and 5 illustrate a different stage widths or stereo perspectives for the same media file, FIG. 4 illustrates a manner of illustrating and/or controlling different parameters including the stage width, and FIG. 6 illustrates a person with earphones.

In FIG. 1, a system 10 is seen comprising a listening position 20 in relation to which a set of speakers is provided. The speakers as a minimum comprises two speakers 12 and 14, but multi channel media systems often comprise 3, 5 or more speakers, such as 7, 9 and sometimes even more than 10, 15 and 20 speakers. In the present embodiment, a centre speaker 16 and back speakers 17 and 18 are illustrated, even though they need not be present and may be replaced by other or additional speakers or speaker positions.

The speakers are fed by a controller 22 which retrieves or receives an audio signal and generates speaker signals for each individual speaker.

The audio signal may be received from a storage of the controller, such as a CD-ROM player, a Blueray player, a memory, such as a hard disc, a RAM, ROM, Flash storage, such as a memory reader, such as a Flash card (SD, Mini SD, Micro SD cards or similar memory card standards), a USB port for providing access to media files on USB memory elements or the like. Alternatively, the controller may be able to receive the audio signal, either as a complete file or streamed, for example, from an external element, such as a broadcasting station via airwaves, via a WiFi connection, the telephone network, NFC, Bluetooth or the like. The source thus may be airborne signals from a WiFi network, telephone network, airborne AM/FM signals, Bluetooth/NFC/RF signals from a more local source, such as a portable element, such as a mobile telephone or media centre (iPad, iPod, laptop or the like).

The conversion of the audio signal into the signals for the speakers is a well known technology, where the signal, depending on the actual type thereof, is converted into the correct signals to be converted into sound fed from the left/right of the listening, from directly in front of the listening position and/or from the back.

The skilled person will know that a stereo signal may be converted into more than 2 speaker signals and that a multi channel signal may be converted into fewer speaker signals if required.

In fact, in some situations, it is desired to provide or emulate loudspeakers and thus generate fictive speakers. By suitable filtering and delay of the signals for the physical speakers 12/14, the sound output may, at the listening position 20, sound as coming from speakers at other positions.

In this manner, the stereo perspective or stage width seen from the user may be adapted in width.

This is illustrated in FIGS. 2 and 3. Often, when listening to stereo music or multichannel music, different persons, voices and/or instruments will be provided at different positions in the stereo perspective. When listening to the music, it is discernible where at least in a horizontal direction, one instrument is positioned in relation to other instruments and/or a vocal.

The producer will set the instruments/vocals into a stage setting to emulate a live experience where the instruments/vocals are physically positioned at different positions.

Thus, from the left-most instrument/vocal to the right-most one, the actual stage width or width of the stereo perspective thus is defined or illustrated by these.

In FIG. 2, a vocal 34 is provided directly in front of the listening position 20 (at the centre of the stage and stereo perspective) and a leftmost instrument 32 and rightmost instruments 34 are illustrated. Additional instruments may be provided between the instruments 32/36. The overall stage width or stereo perspective width is defined by the angle 30 between the outermost instruments 32 and 36 in this example.

Clearly, the sound generating the vocal 34 and instruments 32/36 may be provided by two or more speakers, such as speakers 12/14, provided in relation to the listening position 20.

In one situation, the speakers 12/14 may be positioned, horizontally, at the instruments 32/36 or further away from the vocal/centre 34. However, it is possible to actually have the speakers 12/14 positioned between the vocal/centre 34 and the instruments 32 and 36, respectively, for the listening position 20 to receive sound sounding as if coming from outside the angle span defined by the speakers 12/14 and the listening position 20.

In FIG. 3, the same stage is provided with the same instruments, but it is seen that the width, 30', of the stage is now smaller, the (horizontal) distance between the instruments 32/36 is smaller, but other than that, the sound may be the same (same song).

The stages and stereo perspectives of FIGS. 2 and 3 may be obtained without altering the positions of the actual speakers 12/14 but simply by altering the conversion or signal processing of the audio signal to arrive at the signals fed to the speakers. Multimedia systems exist which have a button for selection between two stage widths, even though this is not the actual description given to the user.

Different situations exist where a wider or more narrow stage width is desirable. If a person or listener is more relaxed, less focused, less concentrated, less poised, and/or has cognitive/perceptive surplus the stage width may be selected wider (larger angle 30/30') than if the person is focused/poised/concentrated, in which situation the stage width may be selected more narrow—typically centred around a direction of focus of the person.

The width thus may be determined or defined in relation to the person's ability to concentrate on the audio provided in addition to which ever other tasks the person has. The width or how quickly it narrows when the person has other tasks will depend on the person's abilities, also in relation to the other tasks. If the other tasks are well known to the person, these tasks take up less of the person's "mental bandwidth" than if they are many in number and/or not known to the person.

Depending on the person, the initial width 30 and the narrowing to the width 30' will be different widths and different angle changes per additional task/difficulty of the task.

If the person is trained to multitask, this person may be able to concentrate on a wider width even when presented to other tasks, than if the person is not good at multitasking.

Different persons or different operators thus may have different parameters or different weights to the parameters.

In the situation where the listening position 20 is in front of, such as defined by, a seat of a means of transport, such as a driver's seat of a vehicle, the width 30/30' may be selected depending on a driving style of the person or a behaviour thereof.

The width may be selected on the basis of a velocity of the car and/or of a driving style, such as the number/frequency of or sizes of accelerations/decelerations, number/frequency or sizes of turns (such as of the vehicle or steering wheel), such as lane changes, or the like.

If the driver accelerates/decelerates (brakes) often or violently, a more focused driver may be expected and the width 30/30' correspondingly narrowed.

As to the turns, the angle of rotation or velocity of rotation (angular velocity) of the vehicle or steering wheel may be used in the determination of the angle 30/30'.

Alternatively, a GPS and/or road map may be used for determining road parameters, such as the amount/size of bends, allowed velocity, type of road (motorway, normal road, city, off road), traffic conditions, or the like. Such parameters may be used in the determination of the width.

Also, the concentration of the driver, or how poised the driver is or seems, may be inferred from other parameters of the driver, such as the behaviour, such as the movements of the driver. If the driver performs staccato movements (fast movements) or is very still (does not move a lot), the driver may be seen as more concentrated, and a narrower width may be selected. If the driver moves a lot (usually slower movements), such as moves his/her head a lot, especially rotation to the sides, and/or if the driver waves his/her hands around, a less concentrated driver may be inferred and a wider width may be selected.

The concentration level of the driver or a passenger may also or in addition be inferred from a noise level, such as an amount of speech, in the vehicle. If the driver or passenger speaks/sings more, a less concentrated person may be inferred and a wider angle may be selected.

In addition, if the driver or passenger operates other equipment, such as a navigation system, a multimedia system, a set-up menu for the vehicle, or the like, a less concentrated driver/passenger may be inferred and a wider angle may be selected.

Combinations of these parameters may be used, and some parameters may be given a higher priority than others. Thus, if the person in question is the driver of the vehicle and the velocity is high and/or the number/sizes of turns is high, these parameters may be given a high priority so that a detection of speech, movement or operation of other equipment still results in the selection of a narrow angle, as the driver should be concentrated during that type of driving.

The angle selection may be different for different persons. In a vehicle, the driver may be concentrated but any passengers need not be. Thus, different parameters may be used for different persons in a vehicle. The driving style may be given prevalence in relation to the driver but movement/speech parameters may be given more weight in the determination of the angle for the passenger(s). Speakers may be provided so that each person may receive stereo sound, preferably from in front of the person when facing toward the front of the vehicle.

As mentioned above, different persons may have different settings (parameters, thresholds etc). In the vehicle situation, the person may be identified from e.g. a seat setting, such as when different users of a vehicle have different seat memory settings and who will select a setting for the seat to adjust to that person's body and driving position. From this selection, the system may identify the person and thereby the settings.

Naturally, the determination of the angle 30/30' may be performed intermittently, such as at regular intervals, constantly or only if a sufficient change in a parameter has taken place. This required amount of change may be defined by the skilled person or even the operator of the system.

In order to derive parameters for the determination of the width, the controller 22 may comprise one or more accelerometers (for sensing acceleration/rotation of the vehicle/steering wheel or the like), a speed sensor, a GPS sensor (for determining velocity, acceleration, rotation, turning, lane changes, road parameters or the like), a camera may be provided (for estimating movement of the person), a heat camera may be used (for e.g. determining whether the person is excited/calm), a microphone may be provided (for picking up speech/singing and/or wind noise/tyre noise, which may be used as an indication of speed, sound indicating road conditions and/or weather conditions). Also seat sensors and/or seat belt sensors may be used for determining where passengers, if any, are positioned in the vehicle in order to provide the desired sound also to such positions. If a seat is empty, the sound provided to other seats in the car may be optimized by not having to take into account the sound at the empty seat.

Position parameters may also be used in the determination of the width. Historic data may be used for comparing a present position with historic positions to determine a historic, same or similar position and therefrom (a historic width value) determine the width. The position may be the same position as a GPS coordinate or in a similar position or in a similar place, where a similar position or place may be a similar type of road/traffic situation, a similar type of environment (beach, house, concert hall, game, forest, city, in a vehicle or the like). Many manners exist of determining a similarity between places, and this will not be described in further detail.

Another manner of determining or using a position is to determine that a person is in a particular position, such as that a person is positioned in or at the listening position. This may be achieved by the person identifying him/herself or via identification sensors, such as fingerprint sensors, iris readers, face recognition, gesture recognition, speech recognition or the like.

In addition, the operator may him/herself control or affect the width if desired.

In FIG. 4, a simple user interface is illustrated which allows the operator to not only define the stage width 30/30' but also other parameters of the sound provided.

In the user interface of FIG. 4, a display on e.g. a touch pad is illustrated where a circle 40 (two circles 40 and 40' are illustrated but only one is provided at the time)j indicates three values: an X coordinate, a Y coordinate and a radius R. The X/Y coordinates may describe sound settings, such as whether the sound is desired relaxed or excited and/or whether the sound is desired warm or bright. Relaxed/excited sound may be obtained by adding compression or controlled non-linear distortion to the audio signal.

A warm/bright sound may be a frequency filtering where a bright sound may give prevalence to higher frequencies and a warmer sound may give more prevalence to lower frequencies.

Other sounds or modes may be:

Reference
- Bass clean and properly leveled (not too much).
- Optimized for all seats.
- Could be a default mode, good for static listening and everyday driving.

Relaxed
- Designed for long trips, cruising.
- Less treble than reference, presence under control.
- Optimized for all seats.
- Significantly larger ASW at the front seats and an increased Envelopment.
- Wide sound stage with fuzzy but stable phantom center.

Party
- Designed for loud music listening.
- Bass heavy, very punchy.
- Staging should be decent, but preference is on timbre.
- Less use of EQ, no high Q and deep cuts, let the speakers play by themselves.
- Opposite to Reference mode.

Focused
- Designed for high speed, sporty driving.
- Bass fast and punchy with flat treble and increased presence.
- A reduced ASW at the front seats.
- Optimized for front seats only.
- Opposite to Relax mode.

In FIG. 5, these modes are illustrated in a car, where the above equalization is combined with a difference in apparent source distance or stage width, where the focused mode (C)

has the smallest apparent source width, the reference (A) has the "normal" width, the relaxed mode (B) has a larger width, and the party mode (D) may have sound coming from all sides as if you were present on the stage and between the artists—or all speakers may be set for optimum sound volume and not optimum resolution.

The controlling of the sound by such two coordinates enables the user to alter the sound in a simple manner without risking altering it to a degree or in a manner where the sound becomes of a low quality. The provider of the system may in this manner allow the user a certain degree of freedom.

Other types of parameters for the X/Y coordinates may also be a selection of types of music. One coordinate may relate to the beats per minute (BPM) of the music, the genre thereof (rock, funk, disco, pop, house, jazz etc.) or a mood of the person or the music.

The circle 40 may be defined with different radii (R). Different radii may be used for defining or in the determination of the width 30/30'. This radius may be defined by or illustrated to the operator. In FIG. 4, two different circles are illustrated at different coordinates and with different radii.

When the user interface comprises a touch screen illustrating the axes and circle of FIG. 4. The position of the circle (centre thereof) may be defined by the person swiping over the surface and thus moving the circle. The radius of the circle may be altered by the user pinching (touching by two fingers at the same time) the circle (such as at two positions within the circle) and varying the distance between the fingers (positions of touch), whereby the increasing of the distance will increase the radius and vice versa.

Naturally, the user interface may be obtained in a number of other manners. Any parameter may be set using a rotatable knob, a displaceable lever, a touch pad, a depressible button, a voice instruction, a movement (detected using e.g. a camera/video camera) of an operator, a keyboard, a mouse, or the like.

Naturally, one or more parameters may, as the radius, be determined from any of the above parameters, such as the speed of a vehicle. It may, for example, be desirable that the beat—or volume—of the music be selected by the same or other parameters as the radius/width.

The user may, for example, select a mode where the driving style or position determines a genre of the music, the beat thereof, a frequency filtering or the like.

To be more specific, for the selected parameter(s), a correlation between each parameter and the determined width may be derived. Thus, a mathematical formula may be used for converting vehicle speed into the angle or a value taken into account when determining the angle. The same may be the situation for all parameters.

A simple type of formula is one wherein the angle is determined as:

$$A=ax+by+cz+k$$

Where x, y and z are selected parameters, a, b, c and k are constants derived so as to arrive at the desired angle, when the parameters have the actual values. Naturally, more elaborate formulas may be used.

It may be desired to use averaged, minimum or maximum values of the parameters, as parameters may alter swiftly and in order to not alter the width too quickly or too often.

The velocity, for example, may be an average velocity determined over a predetermined period of time, such as 1, 2, 3, 5, 10, 20, 40 seconds, 1, 2, 3, 4, 5 minutes or more. The same may be the situation for the other parameters.

Manners of converting an audio signal into speaker signals with differing apparent source widths are described below.

A first manner is that of defining virtual speakers or desired width of stage.

A second manner is that of converting multi-channel signal (stereo or more than two channels) into corresponding mid and side components.

A third manner is that of applying desired processing to reflect desired width of stage and spaciousness. This may include asymmetric gains and filtering to mid and side components, adjusting gains and delays of the system speakers, adding layer of any additional sound processors (audio reflection synthesisers, extracted reflections, etc.)

A fourth manner is that of recombining mid and side components into the original source format.

A fifth manner is that of feeding processed signal into the gain matrix, delay processing, filtering, crossover networks and protection stages. The usual components of the speaker system audio flow.

In another embodiment, the system may be a portable media centre having portable speakers which may be headphones/ear buds. This media centre may comprise any of the above sensors for determining parameters thereof, such as movement/activity of the media centre or a person carrying it. The media centre may be provided as a part of a mobile telephone, a laptop, a tablet, a watch, an iPod-like system or the like. Portable elements of this type routinely have therein sensors of the above types as well as storage capacity, communication elements and signal processors. A person with earphones is seen in FIG. 6.

The invention claimed is:

1. An audio system comprising:

at least two sound generators, positioned in relation to a listening position and each configured to receive a speaker signal and to output sound;

a controller configured to:

receive an input representing a first value, wherein the first value is determined on a basis of a detected position or activity of the audio system and/or a user;

convert, based on the first value, an audio signal into a plurality of speaker signals, and feed each speaker signal to an individual sound generator of the at least two sound generators to have the at least two sound generators output the sound, wherein different first values cause the sound to have different apparent source widths at the listening position; and a display configured to illustrate a shape that indicates at least two second values, wherein the at least two second values are alterable by the user and define at least one parameter of the sound that is output by the at least two sound generators, wherein the at least two second values comprise an X coordinate, Y coordinate, and a radius, the radius defines or determines a corresponding apparent source width, and the X coordinate and the Y coordinate define at least one of a compression of the audio signal, a controlled non-linear distortion of the audio signal, a frequency of the audio signal, a timbre of the audio signal, beats per minute of music, a genre of the music, and a mood of the music.

2. The audio system of claim 1, wherein at least one of:

the X coordinate and the Y coordinate define a position of the shape on the display, and a certain combination of the at least two second values relates to at least one of a sound setting, an operating mode and a mood of the user.

3. The audio system of claim 1, wherein at least one of:

the controller is further configured to convert the audio signal into the plurality of speaker signals based on the at least two second values, and the at least two second values are configured to be altered using at least one of a rotatable knob, a displaceable lever, a touch pad, a depressible button, a voice instruction, a movement of an operator, a keyboard, and a mouse.

4. The audio system of claim 1, further comprising a sensor configured to determine the first value.

5. A vehicle comprising the audio system of claim 4, the sensor being configured to detect a position or activity of the vehicle or a person therein.

6. The vehicle of claim 5, wherein the sensor comprises at least one of: a seat sensor, a seat memory setting selector, an accelerometer, a position sensor, a velocity/speed sensor, a camera, a movement sensor, a microphone, and a rotation sensor.

7. The vehicle of claim 6, wherein the sensor is a velocity/speed sensor, the first value relates to a velocity/speed of the vehicle and wherein the apparent source width decreases with increasing velocity/speed.

8. A portable media center including the audio system of claim 1, wherein the at least two sound generators are configured to be worn at, or on ears of the user.

9. A method of generating sound, the method comprising:

detecting a position or activity of an element or a person and generating a corresponding first value;

receiving an audio signal;

providing a plurality of sound generators in relation to a listening position;

converting the audio signal into a plurality of speaker signals;

feeding each speaker signal to an individual sound generator to have the plurality of sound generators output sound; and illustrating a shape on a display, wherein the shape indicates at least two second values that are alterable by a user and that define at least one parameter of the sound that is output by the plurality of sound generators, wherein different first values cause the sound to have different apparent source widths at the listening position, wherein the at least two second values comprise an X coordinate, Y coordinate, and a radius, the radius defines or determines a corresponding apparent source width, and wherein the X coordinate and the Y coordinate define at least one of a compression of the audio signal, a controlled non-linear distortion of the audio signal, a frequency of the audio signal, a timbre of the audio signal, beats per minute of music, a genre of the music, and a mood of the music.

10. The method of claim 9, wherein the step of detecting the position or the activity is performed intermittently.

11. The method of claim 9, wherein the detection step comprises detecting the position or the activity and wherein the feeding step comprises feeding each speaker signal to speakers worn at, or on ears of the person.

12. The method of claim 9, wherein the step of detecting the position or the activity comprises detecting a position or activity of a vehicle and/or a person in the vehicle.

13. The method of claim 12, wherein the corresponding first value relates to at least one of: a number of persons in the vehicle, a seat memory position of a seat of the vehicle, an acceleration/deceleration of the vehicle, a position of the vehicle, a velocity/speed of the vehicle, an amount of or type of movement of the person, an amount of sound generated by the person, an amount of or type of movement of an element controlled by the person.

14. The method of claim 12, wherein the corresponding first value relates to a velocity/speed of the vehicle and wherein a corresponding apparent source width decreases with increasing velocity/speed.

15. An audio system comprising:

a plurality of sound generators, each being configured to receive a speaker signal and to output sound;

a controller configured to:

receive an input representing a first value, wherein the first value is determined on a basis of a detected position or activity of the audio system and/or a user;

convert, based on the first value, an audio signal into a plurality of speaker signals, and feed each speaker signal to an individual sound generator of the plurality of sound generators to output the sound, wherein different first values cause the sound to include different apparent source widths; and a display configured to illustrate a shape that indicates at least two second values and that define at least one parameter of the sound that is output by the plurality of sound generators, wherein the at least two second values comprise an X coordinate, Y coordinate, and a radius, the radius defines or determines a corresponding apparent source width, and the X coordinate and the Y coordinate define at least one of a compression of the audio signal, a controlled non-linear distortion of the audio signal, a frequency of the audio signal, a timbre of the audio signal, beats per minute of music, a genre of the music and a mood of the music.

16. The audio system of claim 15, wherein at least one of:

the X coordinate and the Y coordinate define a position of the shape on the display, and a certain combination of the at least two second values relates to at least one of a sound setting, an operating mode, and a mood of the user.

17. The audio system of claim 15, wherein at least one of:

the controller is further configured to convert the audio signal into the plurality of speaker signals based on the at least two second values, and the at least two second values are configured to be altered using at least one of a rotatable knob, a displaceable lever, a touch pad, a depressible button, a voice instruction, a movement of an operator, a keyboard and a mouse.

18. The audio system of claim 15, further comprising a sensor configured to determine the first value.

* * * * *